US009364065B2

(12) United States Patent
Liang

(10) Patent No.: US 9,364,065 B2
(45) Date of Patent: Jun. 14, 2016

(54) HAIR CURLER

(71) Applicant: CHEER MASTER TRADING LTD., Kowloon (HK)

(72) Inventor: Xu Liang, Shenzhen (CN)

(73) Assignee: CHEER MASTER TRADING, LTD., Kowloon (HK)

( * ) Notice: Subject to any disclaimer, the term of this patent is extended or adjusted under 35 U.S.C. 154(b) by 0 days.

(21) Appl. No.: 14/302,373

(22) Filed: Jun. 11, 2014

(65) Prior Publication Data

US 2015/0059797 A1 Mar. 5, 2015

(30) Foreign Application Priority Data

Aug. 30, 2013 (CN) ..... 2013 2 0540381 U

(51) Int. Cl.
*A45D 1/04* (2006.01)

(52) U.S. Cl.
CPC ..... *A45D 1/04* (2013.01)

(58) Field of Classification Search
CPC ..... A45D 1/00; A45D 1/04; A45D 1/06; A45D 1/16; A45D 1/18; A45D 2/002; A45D 2/02; A45D 2/36; A45D 20/50; A45D 20/52
See application file for complete search history.

(56) References Cited

U.S. PATENT DOCUMENTS

| | | | | |
|---|---|---|---|---|
| 3,934,597 | A * | 1/1976 | McNair | A45D 1/04 132/232 |
| 4,327,753 | A * | 5/1982 | Bertschi | 132/229 |
| 4,492,241 | A * | 1/1985 | Thaler et al. | 132/229 |
| 2009/0205672 | A1 * | 8/2009 | McDonald | 132/266 |
| 2013/0019890 | A1 * | 1/2013 | Liao et al. | 132/228 |

* cited by examiner

*Primary Examiner* — Rachel Steitz
(74) *Attorney, Agent, or Firm* — Adler Pollock & Sheehan P.C.; Daniel J. Holmander, Esq.; George N. Chaclas, Esq.

(57) ABSTRACT

A hair curler comprises a handle, a roller and a heating part. One end of the roller is fixedly connected to the handle and the heating part is electrically connected to the power source. The hair curler comprises a heat insulation unit which is fixedly disposed on the other end of the roller away from the handle and closes the other end of the roller; an extending part is disposed on the other end of the roller; the heat insulation unit comprises a heat insulation part, an end cap and a fixing member, the end cap is cap joint to the other end of the roller, the heat insulation part is adapted inside the extending part and located between the end cap and the heating part, and the fixing member fixes the end cap with respect to the roller; and the heat insulation part is made of heat insulation materials.

18 Claims, 3 Drawing Sheets

HAIR CURLER

CROSS REFERENCE TO RELATED APPLICATION

This application is related to and claims priority from earlier filed Chinese Patent Application No. ZL201320540381.3 filed on Aug. 30, 2013, which is incorporated herein by reference.

TECHNICAL FIELD

The present utility model relates to a hair curler.

BACKGROUND OF THE INVENTION

An existing hair curler includes a handle, a roller and a heating part. The heating part is disposed inside the roller to heat it and the handle is disposed on one end of the roller, so that users can use the heated roller to curl their hair while holding the handle. In order to further use the hair curler stably, an end cap is disposed on the other end of the roller, which is fixed by screws with respect to the roller. Users can grab the handle and the end cap respectively with two hands to stably curl their hair.

However, given that the end cap is fixed to the heating part inside the roller by screws, a large amount of heat generated by the heating part when using the hair curler will be conducted to the surface of the end cap. Further, given that the screws used for fixing are generally made of metal materials and have a better heat-conducting property, thus, while the heating part heats the roller, the screws are also heated and conduct heat to the end cap through the contact with the end cap, causing the latter to be further heated. The heating temperature is very high when curling hair and the temperature of the heated end cap may be much higher than that of the human body, thus, users may be exposed to the risk of being burned when they grab the end cap for using.

BRIEF SUMMARY OF THE INVENTION

The present utility model aims to provide a hair curler, which can effectively prevent heat from being conducted to the end cap grabbed by users and thus avoid the risk of burning the users.

According to the present utility model, a hair curler is provided, which comprises a handle, a roller and a heating part, wherein, one end of the roller is fixedly connected to the handle, and the heating part is electrically connected to the power source and heats the roller. The hair curler further comprises a heat insulation unit which is fixedly disposed on the other end of the roller away from the handle and closes the other end of the roller; wherein, an extending portion is disposed on the other end of the roller; the heat insulation unit comprises a heat insulation part, an end cap and a fixing member, wherein the end cap is cup joint to the other end of the roller, the heat insulation part is adapted in the extending part and located between the end cap and the heating part, and the fixing member fixes the end cap with respect to the roller; and the heat insulation part is made of heat insulation materials.

According to such construction that a heat insulation part is provided between the end cap and the heating part, the heat generated by the heating part is blocked by the heat insulation part and is not conducted to the end cap, users grabbing the end cap when using the hair curler won't be burned.

Preferably, in the hair curler according to the present utility model, the heating part comprises a conducting component and a heating body; the conducting component is disposed inside the handle and conducts power to the heating body from the power source; the heating body is disposed inside the roller, while the outer peripheral surface of the heating body fits with the inner peripheral surface of the roller so as to heat the roller.

Preferably, in the hair curler according to the present utility model, the extending part forms with a plurality of extending strips extend along the axial direction of the roller and arranged to be spaced from each other, and a plurality of recesses recessed inwardly are formed on the outer surface of the heat insulation part; wherein, when the heat insulation part is adapted inside of the extending part, each of the plurality of extending strips of the extending part is accommodated inside a corresponding recess of the plurality of the recesses of the heat insulation part, so that the heat insulation part is non-rotatable with respect to the roller.

Preferably, in the hair curler according to the present utility model, a fixing bulge is formed on the inner side surface of the end cap; when the end cap is cap joint to the other end of the roller to close the other end of the roller, the fixing bulge is plugged into the corresponding fixing recesses on the heat insulation part so that the end cap is non-rotatable with respect to the roller.

According to above construction, given that the end cap is non-rotatable with respect to the roller, when the users using the hair curler, it won't cause any difficult to the users to control the roller during hair curling as the end cap is non-rotatable.

Preferably, in the hair curler according to the present utility model, when the end cap is cap joint to the other end of the roller to close the other end of the roller, the fixing member is plugged through the heat insulation part and fixedly connects with the heating part so as to fix the end cap with respect to the roller.

Preferably, in the hair curler according to the present utility model, the contact part between the fixing member and the end cap is coated with heat insulation materials.

According to above construction, given that the contact part between the fixing member and the end cap is coated with heat insulation materials, even the heat from the heating part is conducted to the fixing member, the heat conducted to the fixing member can be prevented from being conducted to the end cap so that users can be protected from being burned by over temperature of the end cap.

Preferably, in the hair curler according to the present utility model, the heat insulation material can be silicone rubber.

Preferably, in the hair curler according to the present utility model, the heat insulation part can be formed integrally with the extending part.

Preferably, the hair curler according to the present utility model also comprises a separating member which is located between the end surface of the extending part and the end cap.

DETAILED DESCRIPTION OF PREFERRED EMBODIMENTS

Next, the preferred embodiments of the present utility model will be described according to the drawings.

Figure 1:
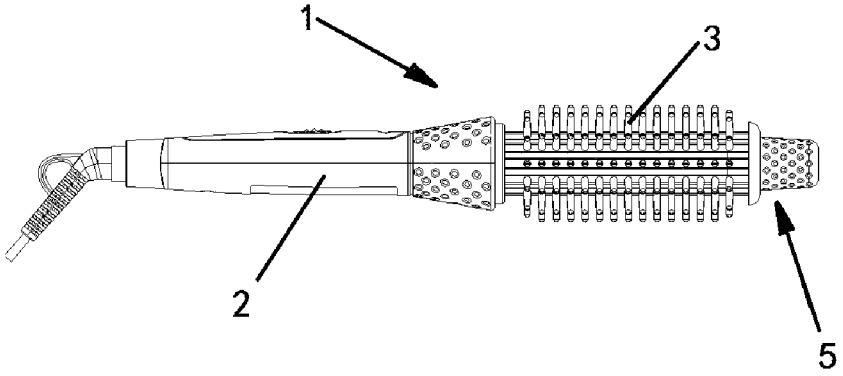
FIG. 1 is a perspective view of the hair curler according to the present utility model.
Figure 2:
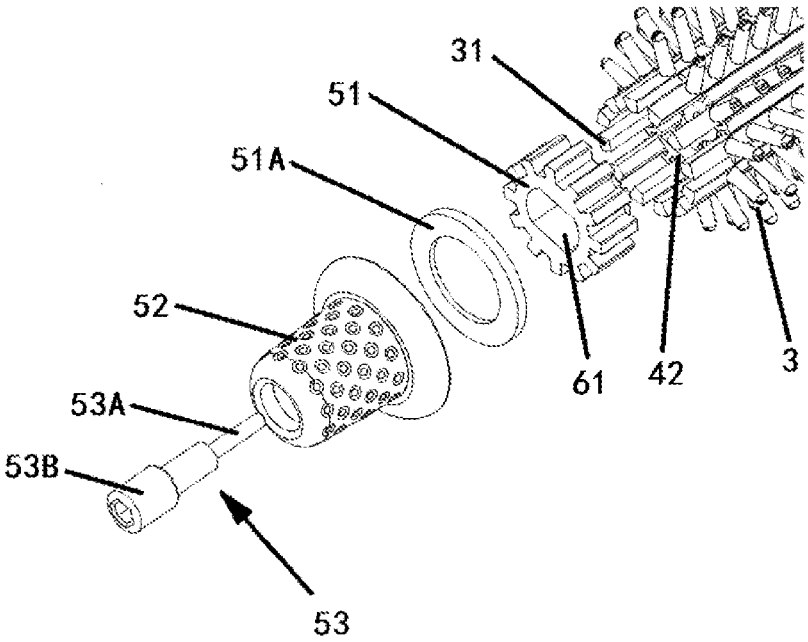
FIG. 2 is a partial exploded perspective view of the hair curler according to the present utility model.
Figure 3:
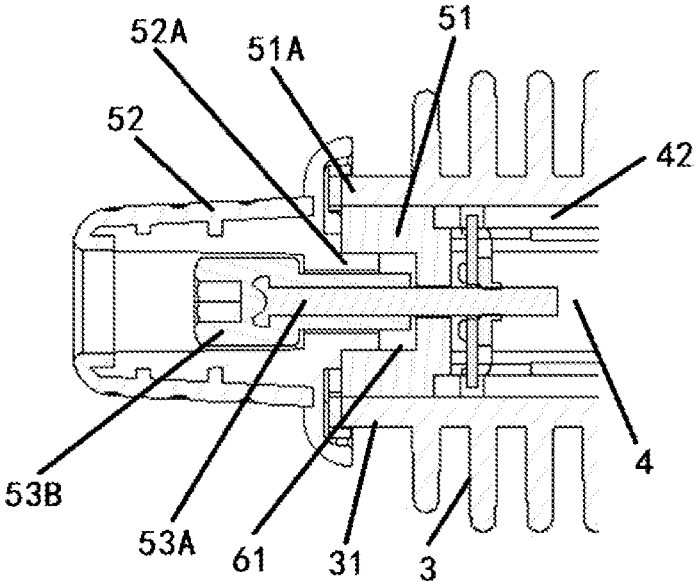
FIG. 3 is a partial sectional view of FIG. 2.

FIG. 1 is a perspective view of the hair curler according to the present utility model. FIG. 2 is a partial exploded perspective view of the hair curler according to the present utility model. FIG. 3 is a partial sectional view of FIG. 2.

A hair curler 1 comprises a handle 2, a roller 3 and a heating part 4. When using the hair curler 1, the handle 2 can be grabbed by user; one end of the roller 3 is fixedly connected to the handle 2; the heating part 4 is electrically connected to the power source (not shown) for heating so as to heat the roller 3.

The heating part 4 comprises a conducting component and a heating body 42; the conducting component is disposed inside the handle 2 and conducts power of the power source to the heating body 42; the heating body 42 is disposed inside the roller 3 and formed with a cylindrical shape, of which the outer peripheral surface fits with the inner peripheral surface of the roller 3 so as to heat the roller 3. When using the hair curler, the conducting component conducts power of the power source to the heating body 42, and then the heating body 42 generates heat and conducts the heat to the roller 3 through the fitting between its outer peripheral surface and the inner peripheral surface of the roller 3, so that the heat of the roller can be used for hair curling.

The hair curler 1 further comprises a heat insulation unit 5 which is fixedly disposed on the other end of the roller 3 away from the handle 2 and closes the other end of the roller 3 so as to prevent the heat generated by the heating part 4 from being conducted to the outer surface of the heat insulation unit 5. When using the hair curler, user simultaneously grabs the handle 2 and the heat insulation unit 5 with both hands to stably rotate the roller 3 for hair curling. Given that the heat is unable to be conducted to the outer surface of the heat insulation unit 5, the outer surface of the heat insulation unit 5 has a low temperature, which will not burn the user.

Specific descriptions of the heat insulation unit according to the preferred embodiments of the present utility model are as follows. The heat insulation unit 5 comprises a heat insulation part 51, an end cap 52 and a fixing member 53.

The heat insulation part 51 is made of heat insulation materials like silicone rubber and so on, and is disposed between the end cap 52 and the roller 3. The heat insulation part 51 is plugged into the other end of the roller 3 to block the heat from the heating part 4, and the heat insulation part 51 is configured to be non-rotatable with respect to the roller 3. More specifically, an extending part 31 is disposed on the other end of the roller 3, and the heat insulation part 51 is adapted inside the extending part 31 and located between the end cap 52 and the heating part 4. Further, the extending part 31 forms a plurality of extending strips extend along the axial direction of the roller 3 and arranged to be spaced from each other, and a plurality of recesses recessed inwardly are formed on the outer surface of the heat insulation part 51. When the heat insulation part 51 is adapted inside of the extending part 31, each of the plurality of the extending strips of the extending part 31 is accommodated inside a corresponding recess of the plurality of the recesses of the heat insulation part 51, so that the heat insulation part 51 is non-rotatable with respect to the roller 3.

Further, the heat insulation part 51 is disposed on the other end of the roller 3 to close the end opening of the roller 3, so as to prevent the heat generated by the heating part 4 from being conducted to the end cap 52 through the end opening. By this way, users can be protected from being burned when they grab the end cap.

In addition, the hair curler also comprises a separating member 51A which is in a ring like shape and is located between the end surface of the extending part and the end cap. The end cap 52 is cap joint to the other end of the roller 3 through the separating member 51A. A fixing bulge is formed on the inner side surface of the end cap 52. When the end cap 52 is cap joint to the other end of the roller 3 to close the other end of the roller 3, the fixing bulge 52A is plugged into the corresponding fixing recesses 61 on the heat insulation part 51. By such configuration, the end cap 52 is non-rotatable with respect to the roller 3.

The contact part between the fixing member 53 and the end cap 52 is coated with heat insulation materials. The fixing member 53 comprises a thread member 53A which is made of materials like metal and so on and a coating part 53B; the coating part 53B comprises a contact part between the fixing member 53 and the end cap 52. The coating part 53B is fixedly cap joint to the thread member 53A from one end of the thread member 53A, and when the fixing member 53 fixes the end cap 52 with respect to the roller 3, one end of the thread member 53A is located on one side of the end cap 52.

When the end cap 52 is cap joint to the other end of the roller 3 to close the other end of the roller 3, the fixing member 53 is plugged through the heat insulation part 51 and is fixedly connected to the heating part 4, so as to fix the end cap 52 with respect to the roller 3. Given that the contact part between the fixing member 53 and the end cap 52 is coated with heat insulation materials, even the heat from the heating part 4 is conducted to the thread member 53A of the fixing member 53, the heat conducted to the threaded member 53A is unable to be conducted to the end cap 52, so that the users can be protected from being burned by over temperature of the end cap 52.

According to the preferred embodiments of the present utility model, the heat insulation part and the extending part are formed to be parts spaced from each other, and both are connected together through plugging of the plurality of recesses and extending strips one by one, however, the present utility model is not limited to these (preferred embodiments). The heat insulation part and the extending part can also form integrally as long as the heat generated by the heating part can be blocked from being conducted to the end cap.

Although a detailed description has been provided for the preferred embodiments of the present utility model, the scope of the present utility model is not limited to this. It should be understood that the skilled in the field can make various modifications within the scope of the present utility model. Thus, the examples disclosed herein are only employed for explanation. It should be understood that the scope of the present utility model is not hence limited but is determined by the following claims.

What is claimed is:

1. A hair curler, comprising:

a handle, a roller and a heating part; wherein, a proximal end of the roller is fixedly connected to the handle, the heating part is electrically connected to a power source, and the heating part heats the roller;

a heat insulation unit fixedly disposed on an open distal end of the roller away from the handle and closes the distal end of the roller; and an extending part is disposed on the distal end of the roller;

wherein: the heat insulation unit comprises a heat insulation part, an end cap and a fixing member, the end cap encloses the open distal end of the roller, the heat insulation part is adapted inside the extending part and located between the end cap and the heating part, and the fixing member fixes the end cap with respect to the roller; and the heat insulation part is made of heat insulation materials;

the extending part forms a plurality of extending strips extending along an axial direction of the roller and arranged to be spaced from each other;

a plurality of recesses recessed inwardly are formed on an outer surface of the heat insulation part; and when the heat insulation part is adapted inside of the extending part, each of the plurality of extending strips of the extending part is accommodated inside a corresponding recess of the plurality of the recesses of the heat insulation part, so that the heat insulation part is non-rotatable with respect to the roller.

2. The hair curler according to claim 1, wherein the heating part comprises a conducting component and a heating body, the conducting component is disposed inside of the handle and conducts power of the power source to the heating element; the heating body is disposed inside of the roller, and an outer peripheral surface of the heating body fits with an inner peripheral surface of the roller, so as to heat the roller.

3. The hair curler according to claim 1, wherein a fixing bulge is formed on an inner side surface of the end cap, when the end cap closes the distal end of the roller, the fixing bulge is plugged into the corresponding fixing recesses on the heat insulation part so that the end cap is non-rotatable with respect to the roller.

4. The hair curler according to claim 3, wherein when the end cap encloses the distal end of the roller, the fixing member is plugged through the heat insulation part and fixedly connects with the heating part so as to fix the end cap with respect to the roller.

5. The hair curler according to claim 4, wherein a contact part between the fixing member and the end cap is coated with heat insulation materials.

6. The hair curler according to claim 5, wherein the heat insulation material is silicone rubber.

7. The hair curler according to claim 1, wherein the heat insulation part forms integrally with the extending part.

8. The hair curler according to claim 1, wherein further comprising a separating member, which is located between the end surface of the extending part and the end cap.

9. A hair curler comprising:

a handle;

a roller connected to the handle, wherein the roller defines an interior and an open distal end;

a heating part mounted in the interior for providing heat to the roller;

an end cap for enclosing the open distal end of the roller; and a fixing member for securing the end cap, wherein the fixing member includes: a first part for coupling to the heating part; and a second insulating part for coupling between the first part and the end cap so that the heat in the first part is isolated from the end cap, wherein the end cap defines a central opening with an inner shoulder and the second insulating part is relatively larger than the first part of the fixing member so that only the second insulating part contacts the inner shoulder to fix the end cap in place.

10. The hair curler according to claim 9, wherein the first part is a threaded screw that couples directly to a distal threaded hole formed in the heating part.

11. The hair curler according to claim 9, further comprising a separating member located between roller and the end cap.

12. A hair curler comprising:

a) a handle;

b) an elongated roller having:

i) a proximal end connected to the handle;

ii) a heating part for heating the roller;

iii) a distal end; and iv) an extending part disposed on the distal end, the extending part forming at least one strip extending along an axial direction of the roller; and c) a heat insulation unit disposed on the distal end of the roller and at least partially inside the extending part, the heat insulation unit including:

i) an end cap;

ii) a heat insulation part between the end cap and the heating part, the heat insulation part forming at least one recess recessed inwardly on an outer surface of the heat insulation part; and iii) a fixing member coupling the end cap to the roller, wherein the at least one extending strip of the extending part is accommodated inside the at least one recess of the heat insulation part so that the heat insulation part is non-rotatable with respect to the roller.

13. The hair curler according to claim 12, wherein the heating part a heating body disposed inside of the roller, and an outer peripheral surface of the heating body fits with an inner peripheral surface of the roller, so as to heat the roller.

14. The hair curler according to claim 12, wherein a fixing bulge is formed on an inner side surface of the end cap, wherein the fixing bulge is plugged into the corresponding fixing recesses on the heat insulation part so that the end cap is non-rotatable with respect to the roller.

15. The hair curler according to claim 12, wherein a contact part between the fixing member and the end cap is coated with heat insulation materials.

16. The hair curler according to claim 15, wherein the heat insulation material is silicone rubber.

17. The hair curler according to claim 12, wherein the heat insulation part is integrally formed with the extending part.

18. The hair curler according to claim 12, wherein further comprising a separating member, which is located between an end surface of the extending part and the end cap.

* * * * *